US005192228A

United States Patent [19]

Collins et al.

[11] Patent Number: 5,192,228

[45] Date of Patent: Mar. 9, 1993

[54] SHIELDED SURFACE MOUNT ELECTRICAL CONNECTOR WITH INTEGRAL BARBED BOARD LOCK

[75] Inventors: Henry B. Collins, Harrisburg; Benjamin H. Mosser, III, Middletown; Steven G. Smith, Linglestown, all of Pa.

[73] Assignee: AMP Inc., Harrisburg, Pa.

[21] Appl. No.: 928,523

[22] Filed: Aug. 11, 1992

Related U.S. Application Data

[63] Continuation of Ser. No. 760,421, Sep. 16, 1991, abandoned.

[51] Int. Cl.[5] ..... H01R 13/73; H01R 13/658

[52] U.S. Cl. ..... 439/567; 439/607

[58] Field of Search ..... 439/567, 607, 609

[56] References Cited

U.S. PATENT DOCUMENTS

| | | | |
|---|---|---|---|
| 4,493,525 | 1/1985 | Hall et al. | 439/610 |
| 4,660,911 | 4/1987 | Reynolds et al. | 439/83 |
| 4,693,528 | 9/1987 | Asick et al. | 439/83 |
| 4,717,219 | 1/1988 | Frantz et al. | 439/82 |
| 4,775,336 | 10/1988 | Paulo | 439/830 |
| 4,776,651 | 10/1988 | Paulo | 439/857 |
| 4,842,552 | 6/1989 | Frantz | 439/557 |
| 4,842,554 | 6/1989 | Asick et al. | 439/609 |
| 4,842,555 | 6/1989 | Cosmos et al. | 439/609 |
| 4,907,987 | 3/1990 | Douty et al. | 439/571 |
| 4,908,335 | 3/1990 | Cosmos et al. | 439/79 |
| 4,938,704 | 7/1990 | Fugiura | 439/95 |
| 4,960,388 | 10/1990 | Frantz et al. | 439/404 |
| 5,037,330 | 8/1991 | Fulponi et al. | 439/607 |

FOREIGN PATENT DOCUMENTS

| | | |
|---|---|---|
| 61-28905 | 11/1986 | Japan . |
| 63-172071 | 3/1988 | Japan . |

*Primary Examiner*—Gary F. Paumen

[57] ABSTRACT

A shielded surface mount electrical connector (10) that has an insulative housing (18) having at least one compliant surface mount contact (30) secured therein. The shield (12) has at least one boardlock (14) integral therewith. The boardlock (14) has at least one spring (78 or 80) for reception in a boardlock receiving aperture (74) in a circuit board (16) on which the connector (10) is mounted. The spring (78 or 80) has at least one barb (92) thereon positioned along the spring (78 or 80) to engage the wall of the boardlock receiving aperture (74).

16 Claims, 6 Drawing Sheets

SHIELDED SURFACE MOUNT ELECTRICAL CONNECTOR WITH INTEGRAL BARBED BOARD LOCK

This application is a continuation of application Ser. No. 07/760,421 filed Sep. 16, 1991, now abandoned.

BACKGROUND OF THE INVENTION

This invention relates to shielded electrical connectors and in particular to shielded surface mount electrical connectors having compliant contacts and a barbed boardlock integral with the shield.

Shielded electrical connectors are known. Examples may be found in U.S. Pat. Nos. 4,842,552 and 4,493,525. Boardlocks have been employed to temporarily secure electrical connectors in a final position on a circuit board until the board passes through a soldering process and the connector is more permanently, all be it removably, secured to the board by the resulting solder joints formed in the soldering process. Shielded connectors with a boardlock integral with the shield are disclosed in U.S. Pat. Nos. 4,842,554 and 4,842,555. Connectors with compliant contacts are disclosed in U.S. Pat. No. 4,693,528 and a shielded connector with compliant contacts are disclosed in U.S. Pat. No. 4,660,911. However, the shielded connectors with compliant contacts have had a separate boardlock to secure the connector to a printed circuit board. For example, the connector disclosed in U.S. Pat. No. 4,660,911 has been used with the top actuated boardlock disclosed in U.S. Pat. No. 4,717,219 which requires tooling in addition to stuffing equipment to place the connector on a printed circuit board.

The prior art boardlocks integral with the shield of a shielded connector would not suffice as a boardlock for a connector with compliant contacts. For example, if the boardlocks integral with the shield of U.S. Pat. Nos. 4,842,554 and 4,842,555 were employed in an electrical connector having compliant contacts, the boardlock disclosed in U.S. Pat. No. 4,842,555 would not hold the connector housing base against the circuit board on which the connector was mounted as the spring action of the compliant contacts would push upwardly, lifting the base of the connector housing off the circuit board. To employ the boardlock disclosed in FIG. 2 of U.S. Pat. No. 4,842,554 also would not suffice to hold the base of the connector housing against the circuit board. The boardlock is resiliently deflected as it is received in an aperture in the circuit board and resiles somewhat as it emerges from the aperture at the lower surface of the circuit board. With the base of the connector housing in its final position seated on the circuit board with the base thereof engaging the upper surface of the circuit board, the boardlock is positioned in the aperture with an inclined surface engaging the periphery of the aperture at the lower surface of the circuit board. The boardlock acts as a spring with the inclined surface engaging the periphery of the aperture to provide a downward force to hold the base of the connector housing against the upper surface of the circuit board. In the application disclosed in U.S. Pat. No. 4,842,554, there is no continuous upward force to counter the action of the boardlock.

To employ the boardlock disclosed in FIG. 2 of U.S. Pat. No. 4,842,554 with a surface mount connector having compliant contacts would not suffice as a boardlock because the downward force provided by the boardlock would be opposed by the upward force of the compliant contacts with the result that the housing would assume a position where the upward and downward forces balance. Under these conditions, the inclined surface boardlock would not be employed as it could not assure that the base of the connector housing was seated against the upper surface of the circuit board.

It would be desirable to have a boardlock integral with the shield of a shielded surface mount connector having compliant contacts that could assure that once placed on a circuit board the base of the connector housing would remain seated against the upper surface of the circuit board until more permanently secured thereto by solder.

SUMMARY OF THE INVENTION

In accordance with the present invention, a shielded surface mount electrical connector has an insulative housing having compliant surface mount contacts secured therein. The shield has at least one boardlock integral therewith. The boardlock has at least one spring member for reception in a boardlock receiving aperture in a circuit board on which the connector is mounted. The spring member has at least one barb thereon positioned along the spring to engage the wall of the boardlock receiving aperture.

DESCRIPTION OF THE PREFERRED EMBODIMENT

Figure 1:
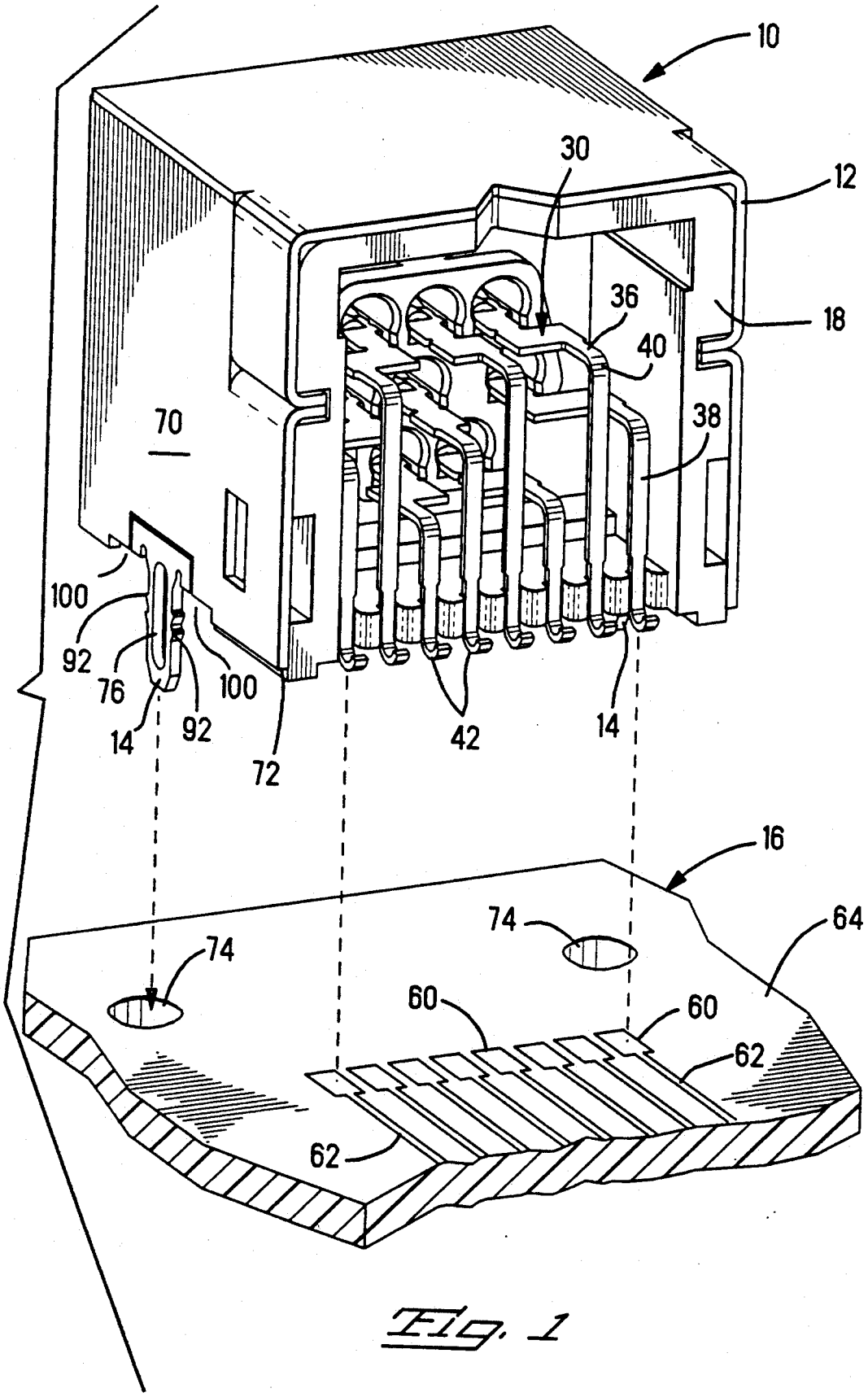
FIG. 1 is a rear perspective view of a shielded surface mount electrical connector having an integral boardlock in accordance with the present invention, exploded from a circuit board.

FIG. 1 shows a shielded surface mount electrical connector 10 including shield 12 having integral barbed boardlocks 14, exploded from a circuit board 16 on which the connector is adapted to be mounted. The preferred embodiment of the invention is a so-called circular DIN connector although the invention is not limited thereto.

Figure 2:
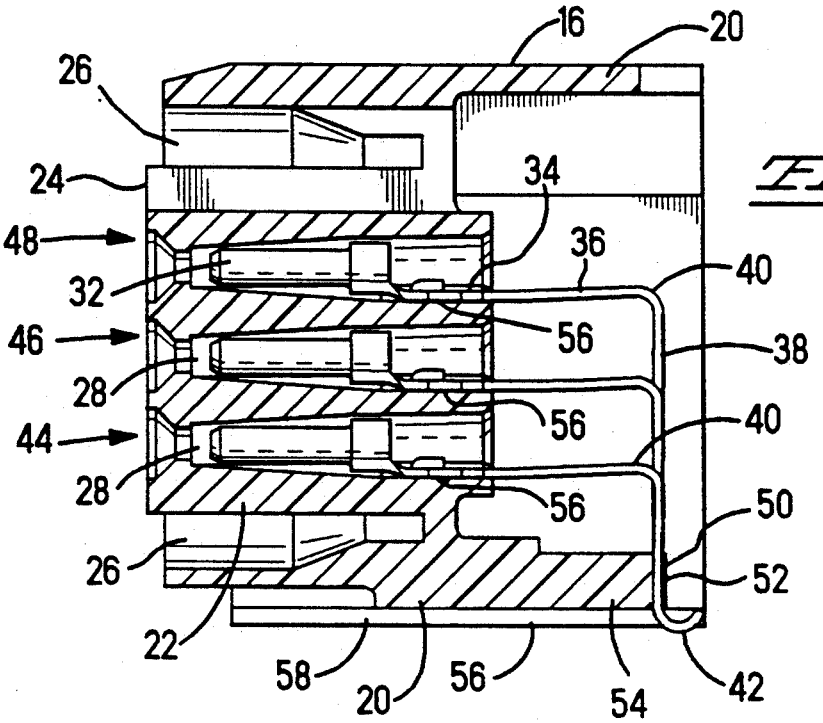
FIG. 2 is a side sectional view of the connector housing with contacts secured in the contact receiving cavities.

Connector 10 includes a dielectric housing 18 molded of a suitable plastic similar to that disclosed in U.S. Pat. No. 4,908,335, the disclosure of which is hereby incorporated by reference. As seen in FIG. 2, housing 18 has a body portion 20 from which a circular cross section plug portion 22 projects forwardly to mating face 24 for mating with a circular cross section externally shielded complimentary connector (not shown) such as disclosed in U.S. Pat. No. 4,960,388. Plug portion 22 is surrounded by an annular recess 26 for receiving the shield of the mating connector. Plug portion 22 has a plurality of contact receiving passages 28 extending rearwardly from mating face 24 through plug portion 22 with contacts 30 secured therein. Contacts 30 have a mating portion 32 in accordance with the teaching of U.S. Pat. No. 4,776,651, the disclosure of which is hereby incorporated by reference, a securing portion 34 in accordance with the teaching of U.S. Pat. No. 4,775,336, the disclosure of which is hereby incorporated by reference, a cantilever arm 36 and a solder tail 38. Cantilever arm 36 is integral with securing portion 34 and extends from securing portion 34 to bend 40 which is formed through more than 90 degrees from the plane of the strip stock. Each contact 30 has a solder tail 38 that extends from bend 40 downward to distal end 42. In the preferred embodiment the mating portion 32 of contacts 30 form as many as three rows at mating face 24. The solder tails 38 of contacts 30 received in the bottom row 44 of contact receiving passages 28 are shorter than the solder tails of contacts 30 received in the middle row 46 of contact receiving passages 28, which in turn are shorter than the solder tails of contacts 30 received in the top row 48 of contact receiving passages. The solder tails from each of three rows of mating portions 32 extend to a single row at distal ends 42. Each solder tail 38 is formed with a portion 50 receivable in a respective formed channel 52 of rib 54 in accordance with the teaching of U.S. Pat. No. 4,660,911, the disclosure of which is hereby incorporated by reference. Rib 54 is integral with housing 18, replacing the spacer plate taught in U.S. Pat. No. 4,908,335.

Each contact 30 is loaded into housing 18, bottom row 44 first followed by middle row 46 then top row 48, by passing mating portion 32 and securing portion 34 into respective contact receiving passages 28 with the lower surface of securing portion 34 maintained against the bottom surface 56 of the respective contact receiving passage 28, into a respective contact receiving passage. As solder tail portion 50 engages a respective channel 52 in rib 54 during insertion, solder tail 38 is biased into a channel with solder tail 38 moving upwardly resulting in a slight upward bow in cantilever arm 36 and a slight inward bow in the upper portion of solder tail 38.

Figure 3:
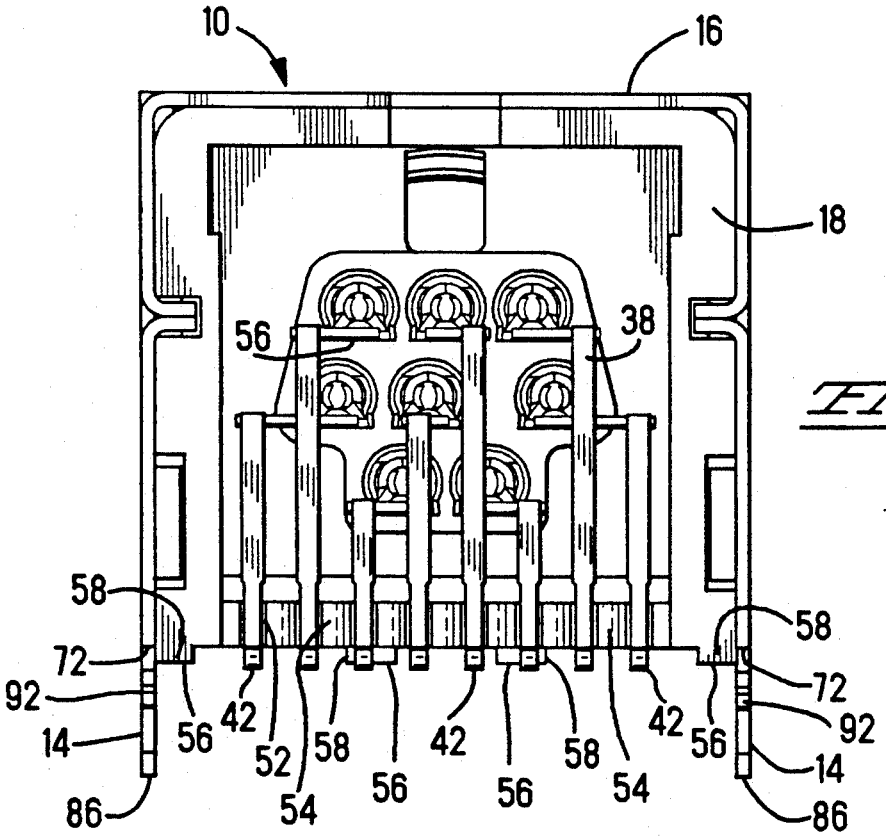
FIG. 3 is a rear view of the connector of FIG. 1.
Figure 4:
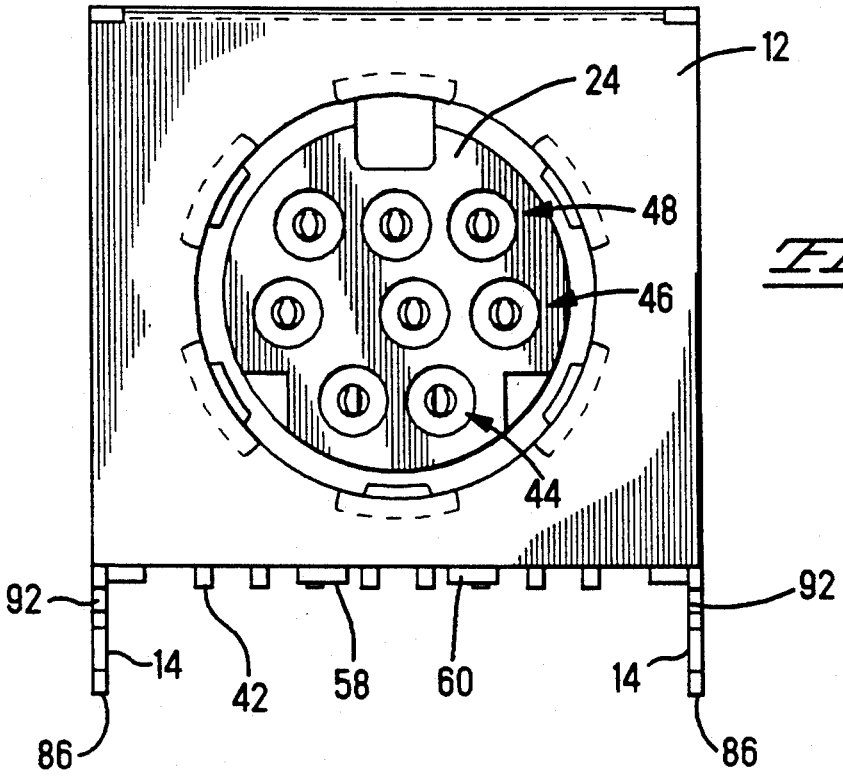
FIG. 4 is a front view of the connector of FIG. 1.

With the contacts 30 seated and secured in housing 18, the distal ends 42 of solder tails 38 extend below the bottom surface 56 of housing 18, as shown in FIGS. 2–4. Bottom surface 56 may take the form of standoffs 58. Distal ends 42 extend to a coplanar array beyond bottom surface 56 for receipt against pads 60 (FIG. 1). Pads 60 are interconnected to traces 62 on the upper surface 64 of circuit board 16 on which connector 10 is mounted. Solder tails 38 can terminate in any known surface mount design such as a butt joint or as shown "J" leg design. In this manner, solder tails 38 are compliant and can accommodate warpage in circuit board 16.

Figure 5:
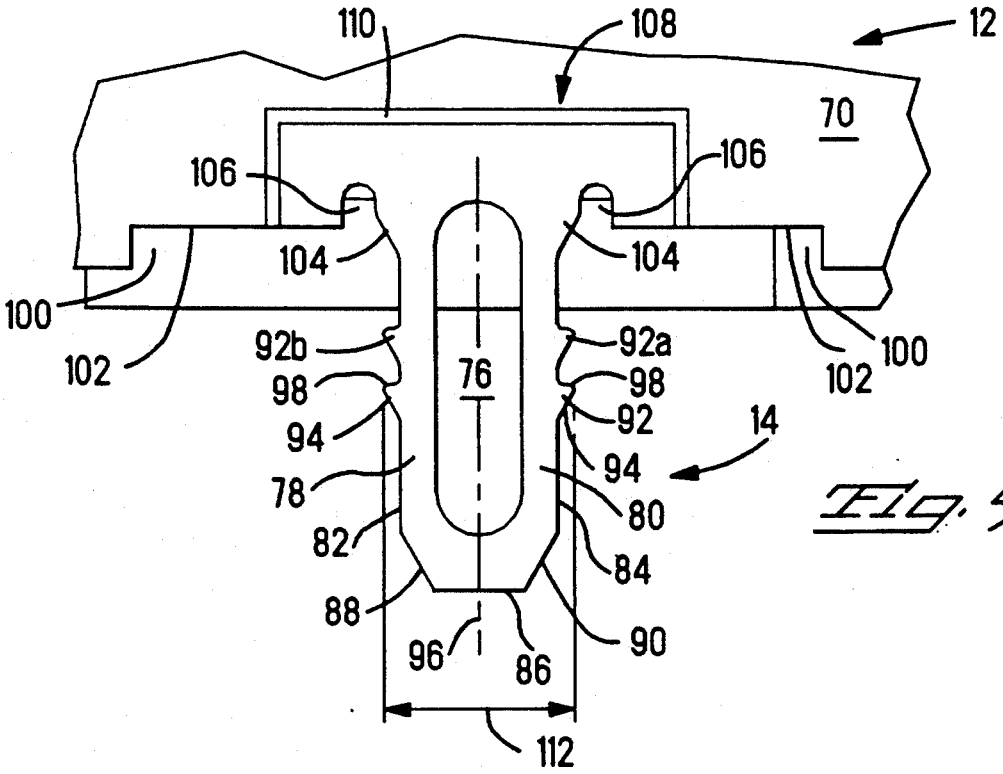
FIG. 5 is an enlarged partial side view of the shield showing an integral boardlock.

Barbed boardlocks 14 are stamped as an integral part of shield 12, which is typically copper. Boardlocks 14 are integral with a side wall 70 of shield 12 extending from an edge 72 thereof proximate bottom surface 56. Boardlocks 14 have many of the same features as the boardlock disclosed in U.S. Pat. No. 4,907,987, the disclosure of which is hereby incorporated by reference. As best seen in FIG. 5, boardlocks 14 extend downward from edge 72 to beyond bottom surface 56 approximately the distance equal to the thickness of a circuit board on which connector 10 will be mounted. Connector 10 typically has two spaced boardlocks 14 for receipt in spaced boardlock receiving apertures 74 (see FIG. 1) in the circuit board 16 on which connector 10 is adapted to be mounted. Boardlocks 14 assist in locating distal ends 42 on respective pads 60.

Barbed boardlock 14 has an elongate central slot 76 extending from proximate end 86 to proximate the plane of edge 72. Slot 76 defines adjacent thereto first and second spring members 78,80. The outer profile of boardlock 14 is defined by sheared first and second surfaces 82,84 which is typically substantially the same as or slightly less than the width of boardlock receiving aperture 74. First and second spring members 78,80 may be interconnected remote from edge 72 forming closed end 86. Closed end 86 may have tapered surfaces 88,90 to facilitate insertion of boardlocks 14 into apertures 74.

Along first and second spring members 78,80 on first and second sheared surfaces 82,84, boardlock 14 has barbs 92 extending laterally beyond the width of first and second spring members 78,80 as defined by first and second sheared surfaces 82,84. Barbs 92 have a tapered surface 94 which in angled toward the center line 96 of boardlock 14 in the direction from edge 72 to end 86. Tapered surface 94 extends to tip 98. Typically barbs 92 are disposed in pairs laterally opposite each other such that a barb **92*a* on first spring member 78 is laterally opposite a barb 92*b* on second spring member 80. The tips 98 of barbs 92*a*,92*b* define a width 112 that is greater than the width of boardlock receiving aperture 74, which typically is 0.054 inches (1.52 mm). Barbs 92 are spaced along first and second spring members 78,80 in the region of elongate slot 76 to engage a wall 114 of a boardlock receiving aperture 74 in circuit board 16 on which connector 10** is mounted.

While boardlock 14 extends from edge 72, there may be a notch 100 in edge 72 in the region of boardlock 14 defining a recessed edge 102. The expanse of notch 100 along edge 72 is sufficient to extend beyond the region around boardlock receiving aperture 74 where solder paste is applied for soldering, connector 10 being compatible with reflow soldering processes.

Each of first and second spring members 78,80 have a widened region 104 adjacent shield 12. Widened region 104 imparts strength to first and second spring member 78,80. Adjacent to widened region 104 is a U-shaped notch 106 that provides a longer beam length to first and second spring members 78,80 than would exist if the first and second spring members terminated at edge 72 or edge 102. U-shaped notch 106 also minimizes failure of first and second spring members 78,80 as they flex in their plane.

A solder barrier 108 such as a score line 110 may be provided on the side wall 70 of shield 12 near boardlock 14. Solder barrier 108 extends from recessed edge 102 on one side of boardlock 14 adjacent first spring member 78 to recessed edge 102 on the other side of boardlock 14 adjacent spring member 80. Solder barrier 108 provides an impediment to the migration of solder up side wall 70 of shield 12 during soldering and while extending from locations on recessed edge 102 on both sides of boardlock 114, typically intersects recessed edge 102 beyond the region around the boardlock receiving aperture 74 where solder paste is applied.

Typically shield 12 is made of phosphor bronze 0.0125 inches (0.32 mm) thick and plated. A typical boardlock 14 has sheared surfaces 82,84 that are spaced 0.054 inches (1.37 mm) apart with spaced pair of barbs 92a,92b extending to 0.069 inches (1.75 mm). Slot 76 is 0.028 inch (0.71 mm) wide, centered- between sheared surfaces 82,84 and is 0.120 inch (3.05 mm) long spaced 0.020 inch (0.51 mm) from end 86. Notch 106 extends 0.016 inch (0.41 mm) above edge 102 which is 0.015 inch (0.38 mm) above edge 72.

Figure 6:
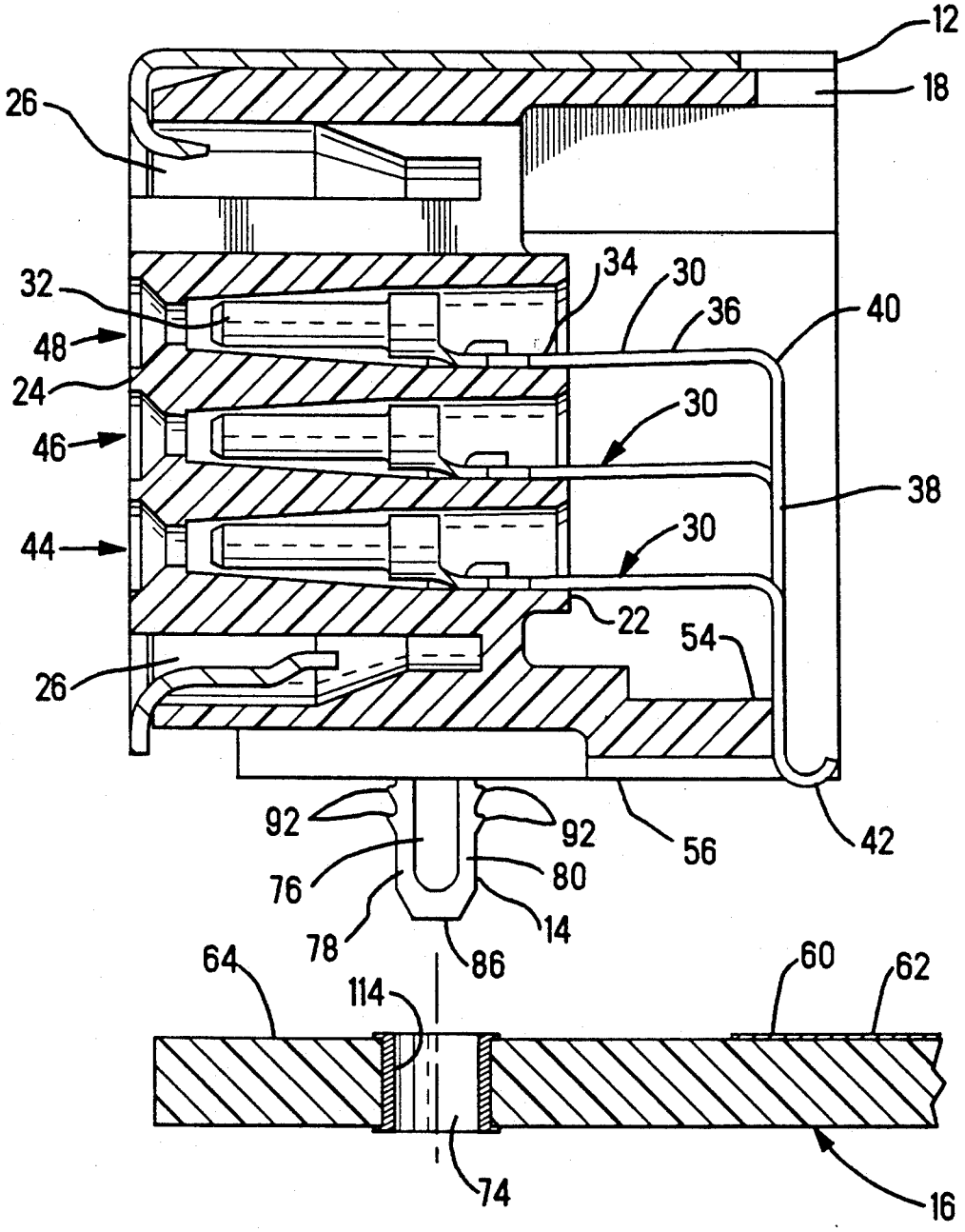
FIG. 6 is a side sectional view of the connector of FIG. 1 positioned above a circuit board with the boardlock aligned with a boardlock receiving aperture.

Connector 10 is assembled to a circuit board 16 by positioning connector 10 over the board as shown in FIG. 6 with spaced boardlocks 14 aligned with predrilled, plated through holes in the form of boardlock receiving apertures 74. It is recognized that boardlock receiving apertures 74 may not be plated. Typically, mating face 24 is positioned over of an edge of circuit board 16.

Connector 10 is moved toward the board with boardlocks 14 received in boardlock receiving apertures, guided by tapered surfaces 88,90. As connector 10 moves closer to the board, barbs 92 pass into boardlock receiving aperture 74; a reaction of the periphery thereof cause slight inward deflection of first and second spring members 78,80 as tapered surfaces 94 ride along the periphery of the aperture. Barbs 92 enter the aperture and bite into the interior wall 114 of boardlock receiving aperture 74.

Figure 7:
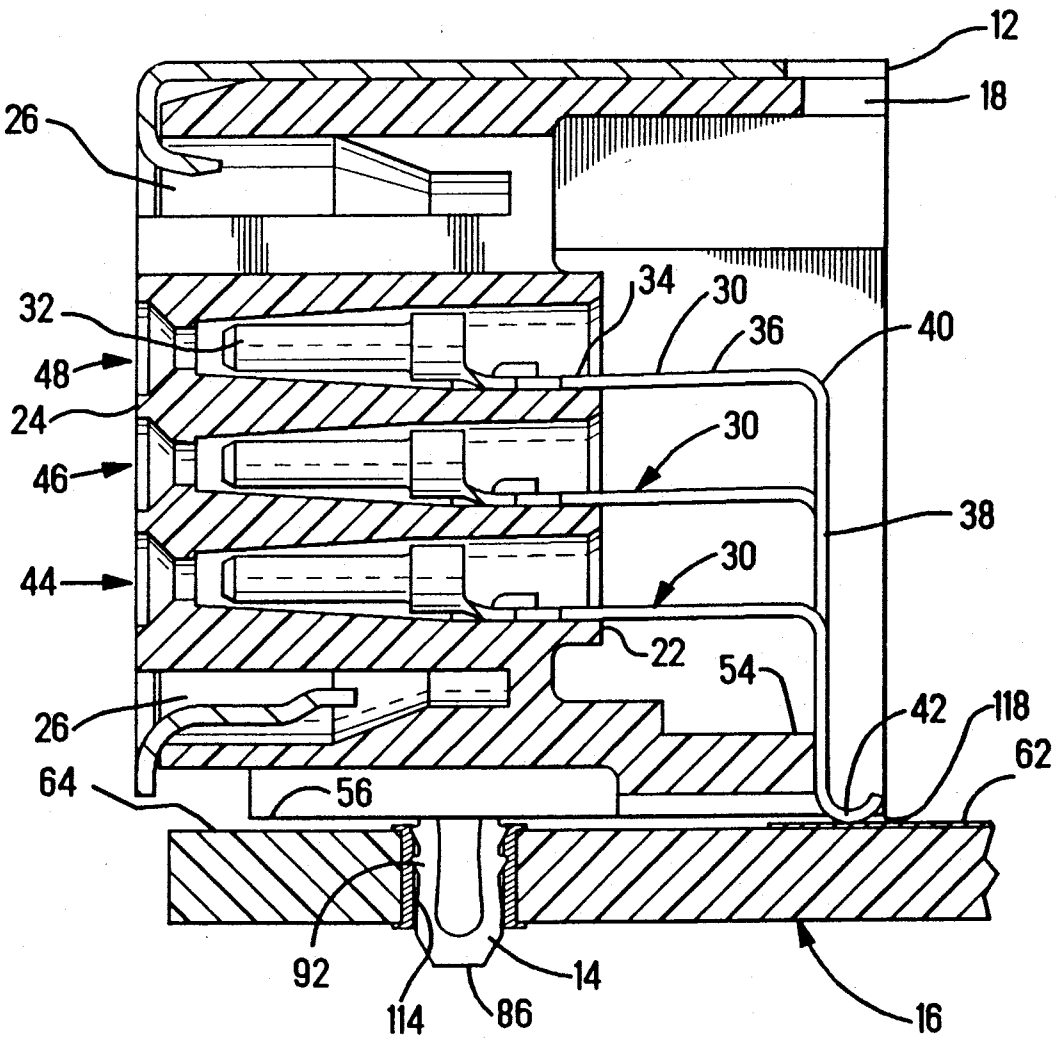
FIG. 7 is a side sectional view of the connector of FIG. 6 subsequent to being moved toward the circuit board until the solder tails engage pads on the upper surface of the board.
Figure 8:
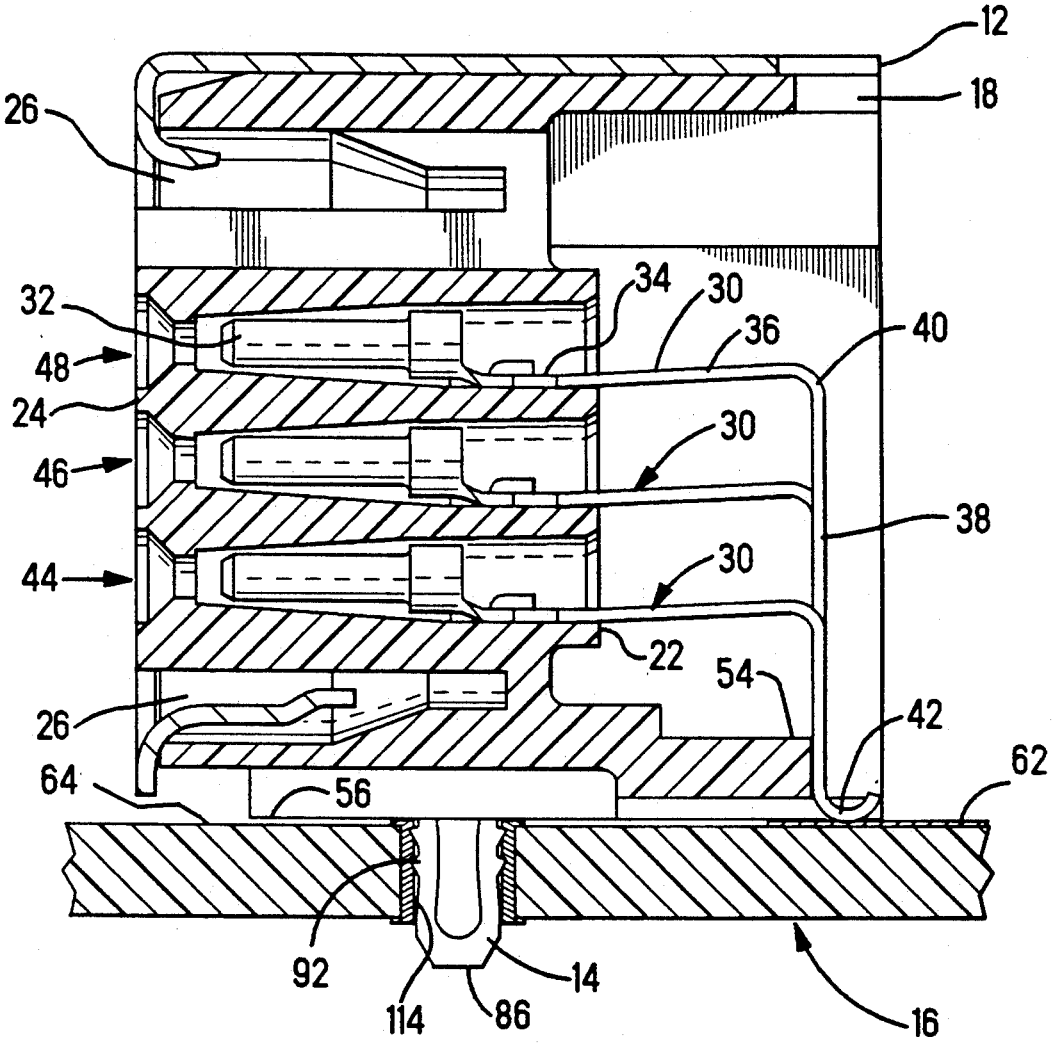
FIG. 8 is a side sectional view of the connector of FIG. 7 with the connector housing seated against the upper surface of the circuit board.

Movement of connector 10 toward surface 64 continues until distal ends 42 engage surface 64, specifically pad 60 thereon as shown in FIG. 7. At this point of mounting connector 10 on circuit board 16, bottom surface 56 is spaced from surface 64 as indicated by space 118.

Continued movement of connector 10 toward surface 64 moves boardlock 14 and hence barbs 92 further into boardlock receiving aperture 74 as cantilever arms 36 flex and bend upwardly. Solder tails 38 move upwardly relative to housing 18 as portions 50 slide in a respective channel 52 in rib 54. The upward bending of cantilever arms 38 applies continuous pressure to solder tails 38 to urge distal ends 42 downward against pads 62 to assure compliance of distal ends 42 with respective pads 60 on circuit board 16. Solder joints (not shown) may be formed by reflowing solder placed on pads 60 prior to positioning connector 10 on board 16. The continually applied force provided by the compliant action of cantilever arms 36 must be overcome by the boardlock that holds connector 10 on the circuit board until soldering of the boardlock takes over this function. Barbs 92 engage wall 114 in an interference fit to secure connector 10 to circuit board 16, overcoming the continually applied force of the compliant contacts. Any force tending to cause boardlock 14 to back out of boardlock receiving aperture 74 causes barbs 92 to bite into wall 114 to more effectively maintain boardlock 14 in the apertures and therefore hold connector 10 on the board until it is more permanently secured thereto by solder. In this manner, boardlock 14 is held in tension and very effectively maintains the base 56 against the upper surface of a circuit board on which the connector is mounted even under the conditions that the base of the connector is continuously being urged away from the upper surface of the board by the compliant contacts contained in the very connector that needs to be held against the board.

We claim:

1. An electrical connector, comprising: an insulative housing, conductive electrical contacts in said housing having bendable portions connected to solder tails extending to initial positions below said housing, a conductive shield over said housing, and circuit board engaging board locks extending from said shield below said housing, barbs on said board locks gripping walls of apertures in a circuit board for holding said housing against said circuit board and for holding said solder tails against pads on said circuit board while said solder tails have been moved upwardly from their initial positions bending the bendable portions of said contacts and creating forces exerted by said solder tails against said pads on said circuit board, and further comprising solder barriers in the form of recessed score lines in said shield, said score lines extending above respective board locks, and opposite ends of said score lines intersecting respective edges of said shield.

2. An electrical connector as recited in claim 1, comprising: cantilever arm portions of said contacts from which said solder tails extend, said cantilever arm portions of said contacts being bendable upon movement upwardly of said solder tails from their initial positions.

3. An electrical connector as recited in claim 1, comprising: channels in a portion of said housing receiving said solder tails, and said solder tails being moveable upwardly along said channels.

4. An electrical connector as recited in claim 1, comprising: said barbs being on opposite sides of respective said board locks, and central slots between opposite sides of respective said board locks.

5. An electrical connector as recited in claim 1, comprising: respective said boardlocks being widened by regions thereof, and the boardlocks and the regions thereof being unitary with said shield.

6. An electrical connector as recited in claim 1, comprising: inverted notches in respective edges of said shield, said boardlocks extend from said edges within respective said notches, and said boardlocks being widened by respective regions thereof within respective said notches and joined to said edges.

7. An electrical connector, comprising: an insulative housing, conductive electrical contacts in said housing having solder tails extending for connection to a circuit board, a conductive shield over said housing, circuit board engaging board locks extending from said shield below said housing, barbs on said board locks gripping walls of apertures in a circuit board for holding said housing against said circuit board, solder barriers in the form of recessed score lines in said shield, said score lines extending above respective said board locks, and opposite ends of said score lines intersecting respective edges of said shield.

8. An electrical connector as recited in claim 7, comprising: cantilever arm portions of said contacts from which said solder tails extend, said cantilever arm portions of said contacts being bendable upon movement upwardly of said solder tails from their initial positions.

9. An electrical connector as recited in claim 7, comprising: channels in a portion of said housing receiving said solder tails, and said solder tails being moveable upwardly along said channels.

10. An electrical connector as recited in claim 7, comprising: said barbs being on opposite sides of respective said board locks, and central slots between opposite sides of respective said board locks.

11. An electrical connector as recited in claim 7, comprising: respective said boardlocks being widened by regions thereof, and the boardlocks and the regions thereof being unitary with said shield.

12. An electrical connector as recited in claim 7, comprising: inverted notches in respective edges of said shield, said boardlocks extend from said edges within respective said notches, and said boardlocks being widened by respective regions thereof within respective said notches and joined to said edges.

13. An electrical connector, comprising: an insulative housing, conductive electrical contacts in said housing having solder tails extending for connection to a circuit board, a conductive shield over said housing, circuit board engaging board locks extending from said shield below said housing, barbs on said board locks gripping walls of apertures in a circuit board for holding said housing against said circuit board, inverted notches in respective edges of said shield, said boardlocks extend from said edges within respective said notches, and said boardlocks being widened by respective widened regions thereof, said widened regions being within respective said notches and joined to said edges, and further comprising solder barriers in the form of recessed score lines in said shield, said score lines extending above respective board locks, and opposite ends of said score lines intersecting respective edges of said shield.

14. An electrical connector as recited in claim 13, comprising: cantilever arm portions of said contacts from which said solder tails extend, said cantilever arm portions of said contacts being bendable upon movement upwardly of said solder tails from their initial positions.

15. An electrical connector as recited in claim 13, comprising: channels in a portion of said housing receiving said solder tails, and said solder tails being moveable upwardly along said channels.

16. An electrical connector as recited in claim 13, comprising: said barbs being on opposite sides of respective said board locks, and central slots between opposite sides of respective said board locks.

* * * * *